US010777902B2

(12) United States Patent
Kawahata

(10) Patent No.: US 10,777,902 B2
(45) Date of Patent: Sep. 15, 2020

(54) LUNEBURG LENS ANTENNA DEVICE

(71) Applicant: Murata Manufacturing Co., Ltd., Kyoto (JP)

(72) Inventor: Kazunari Kawahata, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/987,291

(22) Filed: May 23, 2018

(65) Prior Publication Data

US 2018/0269586 A1 Sep. 20, 2018

Related U.S. Application Data

(63) Continuation of application No. PCT/JP2016/082630, filed on Nov. 2, 2016.

(30) Foreign Application Priority Data

Nov. 24, 2015 (JP) ..... 2015-228645

(51) Int. Cl.
*H01Q 15/08* (2006.01)
*H01Q 21/28* (2006.01)
(Continued)

(52) U.S. Cl.
CPC ..... *H01Q 15/08* (2013.01); *H01Q 1/3233* (2013.01); *H01Q 19/062* (2013.01); *H01Q 21/0025* (2013.01); *H01Q 21/064* (2013.01); *H01Q 21/065* (2013.01); *H01Q 21/08* (2013.01); *H01Q 21/28* (2013.01)

(58) Field of Classification Search
CPC ..... H01Q 15/08
See application file for complete search history.

(56) References Cited

U.S. PATENT DOCUMENTS 3,307,187 A 2/1967 Horst
6,426,814 B1 7/2002 Berger et al.
(Continued)

FOREIGN PATENT DOCUMENTS

CN 102122762 A 7/2011
DE 4430832 A1 11/1995
(Continued)

OTHER PUBLICATIONS

International Search Report for International Application No. PCT/JP2016/082630, dated Jan. 17, 2017.
(Continued)

*Primary Examiner* — Robert Karacsony
(74) *Attorney, Agent, or Firm* — Pearne & Gordon LLP

(57) ABSTRACT

A Luneburg lens antenna device includes a Luneburg lens and an array antenna. The Luneburg lens is formed in a cylindrical shape, and the Luneburg lens includes three dielectric layers through having different dielectric constants and stacked on each other in the radial direction. The array antenna includes plural antenna elements disposed on an outer peripheral surface of the Luneburg lens and at different positions of focal points in the peripheral direction and in the axial direction of the Luneburg lens. The array antenna is provided in a range which is ½ or smaller of the entire range of the Luneburg lens in the peripheral direction.

6 Claims, 10 Drawing Sheets

(51) Int. Cl.

| | |
|---|---|
| ***H01Q 21/08*** | (2006.01) |
| ***H01Q 21/06*** | (2006.01) |
| ***H01Q 1/32*** | (2006.01) |
| ***H01Q 19/06*** | (2006.01) |
| ***H01Q 21/00*** | (2006.01) |

(56) References Cited

U.S. PATENT DOCUMENTS

| | | | | |
|---|---|---|---|---|
| 10,468,777 | B2 * | 11/2019 | Kawahata ..... | H01Q 19/06 |
| 2002/0024477 | A1 | 2/2002 | Foncin | |
| 2015/0091767 | A1 | 4/2015 | Matitsine et al. | |

FOREIGN PATENT DOCUMENTS

| | | | |
|---|---|---|---|
| GB | 1366259 | A | 9/1974 |
| JP | 2001-352211 | A | 12/2001 |
| JP | 2003-511974 | A | 3/2003 |
| JP | 2006-054730 | A | 2/2006 |
| JP | 2010-177983 | A | 8/2010 |

OTHER PUBLICATIONS

Written Opinion for International Application No. PCT/JP2016/082630, dated Jan. 17, 2017.
Notice of Reasons for Rejections for Japanese Application No. 2017-552338, dated Dec. 4, 2019.
Notification of the First Office Action for Chinese Patent Application No. 201680068305.3, dated Dec. 24, 2019.

* cited by examiner

LUNEBURG LENS ANTENNA DEVICE

This is a continuation of International Application No. PCT/JP2016/082630 filed on Nov. 2, 2016 which claims priority from Japanese Patent Application No. 2015-228645 filed on Nov. 24, 2015. The contents of these applications are incorporated herein by reference in their entireties.

BACKGROUND

Technical Field

The present disclosure relates to a Luneburg lens antenna device including a Luneburg lens.

An antenna device that can receive radio waves from plural satellites by using a Luneburg lens is known (see Patent Document 1, for example). In the antenna device disclosed in Patent Document 1, microwave transmit-and-receive modules are disposed at positions of focal points of a Luneburg lens. This antenna device receives radio waves from a target satellite as a result of changing the receiving direction of radio waves by shifting the positions of the transmit-and-receive modules.

Patent Document 1: Japanese Unexamined Patent Application Publication No. 2001-352211

BRIEF SUMMARY

In Patent Document 1, the application of the antenna device to MIMO (multiple-input and multiple-output), for example, is not considered. Consequently, conditions for achieving wide-angle scanning and the formation of multiple beams are not discussed in Patent Document 1. Additionally, it is necessary to extract signals from plural transmit-and-receive modules provided on the surface of a spherical Luneburg lens by using cables. The provision of extra members, such as that for supporting the cables, is thus required in addition to the Luneburg lens.

The present disclosure has been made in view of the above-described problems of the related art. The present disclosure provides a Luneburg lens antenna device which achieves wide-angle scanning and the formation of multiple beams.

(1) To solve the above-described problems, a Luneburg lens antenna device according to the present disclosure includes: a Luneburg lens that is formed in a cylindrical shape and has a distribution of different dielectric constants in a radial direction; and an array antenna that includes a plurality of antenna elements disposed on an outer peripheral surface of the Luneburg lens and at different positions of focal points in a peripheral direction and in an axial direction of the Luneburg lens. The array antenna is provided in a range which is ½ or smaller of an entire range of the Luneburg lens in the peripheral direction.

According to the present disclosure, the array antenna includes plural antenna elements disposed on the outer peripheral surface of the Luneburg lens and at different positions of focal points in the peripheral direction of the Luneburg lens. Using of the plural antenna elements disposed at different positions in the peripheral direction can form beams having low sidelobes in different directions and can also form multiple beams. Providing of the plural antenna elements at different positions in the axial direction can make beams narrow in the axial direction, thereby increasing the antenna gain. Additionally, the array antenna is formed in a range which is ½ or smaller of the entire range of the Luneburg lens in the peripheral direction. It is thus possible to scan beams in accordance with the range of the array antenna in the peripheral direction. The Luneburg lens is formed in a cylindrical shape, so that signal connecting lines can be formed on the outer peripheral surface of the Luneburg lens. The antenna device can thus extract signals more easily than when using a spherical Luneburg lens.

(2) In the present disclosure, in the array antenna, a plurality of antenna elements disposed at different positions in the axial direction of the Luneburg lens is operated mutually dependently.

According to the present disclosure, in the array antenna, plural antenna elements disposed at different positions in the axial direction of the Luneburg lens are operated mutually dependently. In this case, the plural antenna elements disposed at different positions in the axial direction of the Luneburg lens are not formed as a MIMO configuration, but the plural antenna elements disposed at different positions in the peripheral direction of the Luneburg lens are formed as a MIMO configuration. Signals having a predetermined relationship, such as signals having a fixed phase difference, are supplied to the plural antenna elements arranged in the axial direction. In other words, signals are independently supplied to the plural antenna elements disposed at different positions in the peripheral direction. This can simplify the configuration of a transmit-and-receive circuit.

(3) In the present disclosure, a plurality of the array antennas is provided at different positions of the Luneburg lens in the axial direction. Ranges in which the plurality of the array antennas is provided in the peripheral direction are at least partially different from each other.

According to the present disclosure, plural array antennas are provided at different positions of the Luneburg lens in the axial direction. The ranges in which the array antennas are provided in the peripheral direction are at least partially different from each other. The range of angles of beam scanning thus becomes wider than that when a single array antenna is used. For example, beams can be radiated all around the Luneburg lens.

(4) In the present disclosure, concerning the plurality of array antennas, the number of antenna elements of one array antenna disposed in the axial direction is different from that of another array antenna disposed in the axial direction.

In the present disclosure, concerning the plurality of array antennas, the number of antenna elements of one array antenna disposed in the axial direction is different from that of another array antenna disposed in the axial direction. The array antenna having more antenna elements in the axial direction can form beams having high directivity that can reach a far side. In contrast, the array antenna having fewer antenna elements in the axial direction can form beams having low directivity that can reach a near side over a wide angle range. With this configuration, in response to the specifications of an antenna device in which the characteristics are different in the peripheral direction, the antenna device can generate beams having different shapes in accordance with the demanded characteristics.

DETAILED DESCRIPTION

Figure 1:
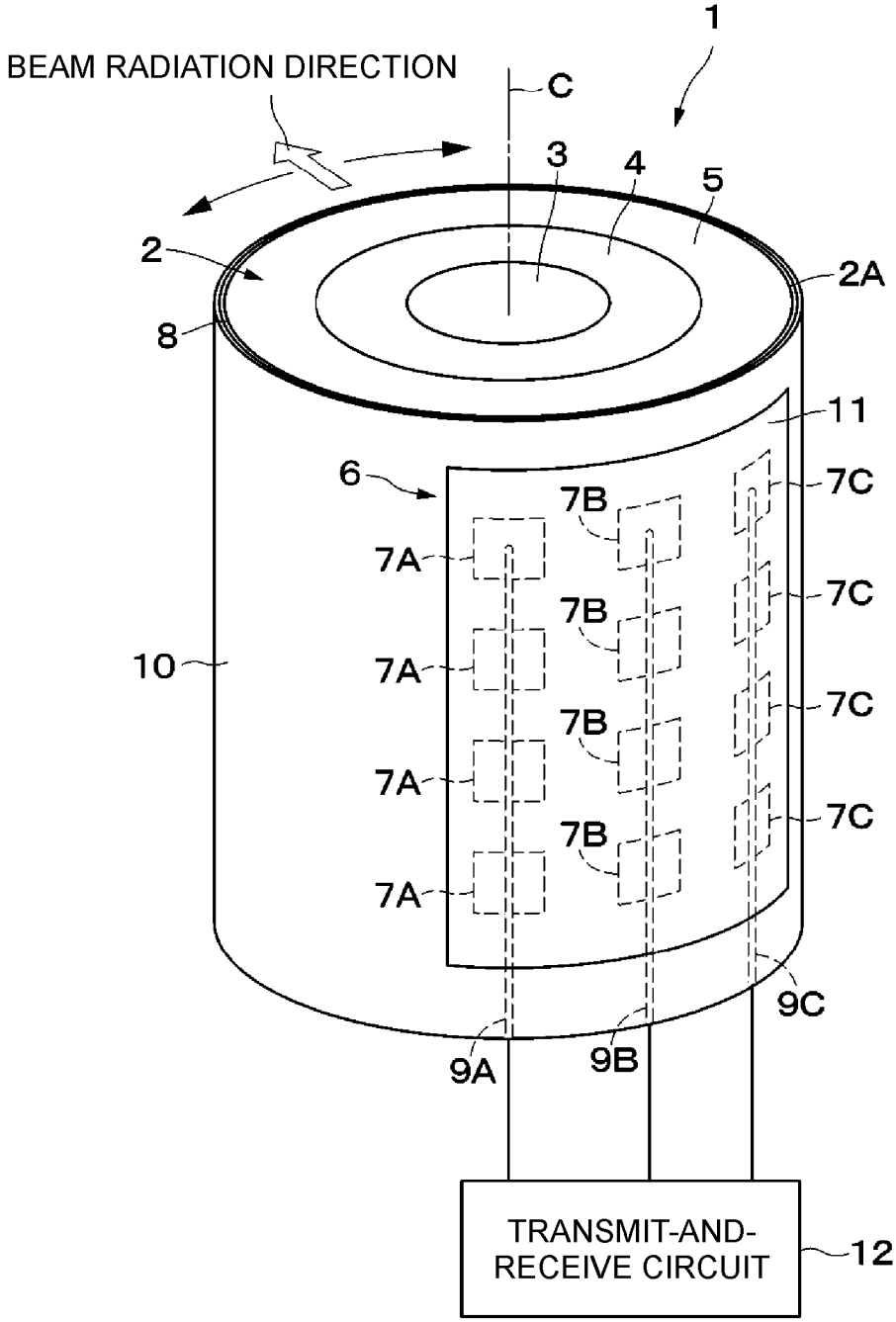
FIG. 1 is a perspective view of a Luneburg lens antenna device according to a first embodiment.

A Luneburg lens antenna device according to embodiments of the present disclosure will be described below in detail with reference to the accompanying drawings.

A Luneburg lens antenna device 1 (hereinafter called the antenna device 1) according to a first embodiment is shown in FIGS. 1 through 7. The antenna device 1 includes a Luneburg lens 2 and an array antenna 6.

The Luneburg lens 2 is formed in a cylindrical shape and has a distribution of different dielectric constants in the radial direction. More specifically, the Luneburg lens 2 includes plural (three, for example) dielectric layers 3 through 5 stacked on each other from the center to the outside portion in the radial direction. The dielectric layers 3 through 5 have different dielectric constants $\varepsilon 1$ through $\varepsilon 3$, respectively, which are decreased in stages from the center (central axis C) to the outside portion in the radial direction. The cylindrical dielectric layer 3 positioned at the center in the radial direction has the largest dielectric constant, the tubular dielectric layer 4 which covers the outer peripheral surface of the dielectric layer 3 has the second largest dielectric constant, and the tubular dielectric layer 5 which covers the outer peripheral surface of the dielectric layer 4 has the smallest dielectric constant ($\varepsilon 1 > \varepsilon 2 > \varepsilon 3$). The Luneburg lens 2 configured as described above forms a radio wave lens. For electromagnetic waves of a predetermined frequency, the Luneburg lens 2 forms plural focal points at different positions in the peripheral direction on the outer peripheral surface.

In FIG. 1, the Luneburg lens 2 having the three dielectric layers 3 through 5 is shown as an example. However, the present disclosure is not restricted to this type of Luneburg lens. The Luneburg lens may have two dielectric layers or four or more dielectric layers. If dielectric layers are constituted by materials having different dielectric constants stacked on each other, thermo-compression bonding is typically used for stacking the materials. In this case, at the interface between two materials, a layer having a dielectric constant different from those of the two materials may be formed because of the influence of mutual diffusion, for example. FIG. 1 shows an example in which the dielectric constant changes in a stepwise manner (in stages) in the radial direction of the Luneburg lens. However, the dielectric constant may change gradually (continuously) in the radial direction of the Luneburg lens.

The array antenna 6 includes plural (twelve, for example) patch antennas 7A through 7C, power supply electrodes 9A through 9C, and a ground electrode 11.

The twelve patch antennas 7A through 7C are provided on an outer peripheral surface 2A of the Luneburg lens 2, that is, on the outer peripheral surface of the outermost dielectric layer 5. The patch antennas 7A through 7C are disposed at different positions in the peripheral direction and in the axial direction in a matrix form (four rows by three columns). The patch antennas 7A through 7C are formed of, for example, rectangular conductive film (metal film) extending in the peripheral direction and in the axial direction of the Luneburg lens 2, and are connected to the power supply electrodes 9A through 9C, respectively. Upon receiving radio-frequency signals from the power supply electrodes 9A through 9C, the patch antennas 7A through 7C serve the function of antenna elements (radiating elements). The patch antennas 7A through 7C are thus able to send or receive radio signals, such as submillimeter-wave and millimeter-wave signals, in accordance with the lengths of the patch antennas, for example.

Figure 2:
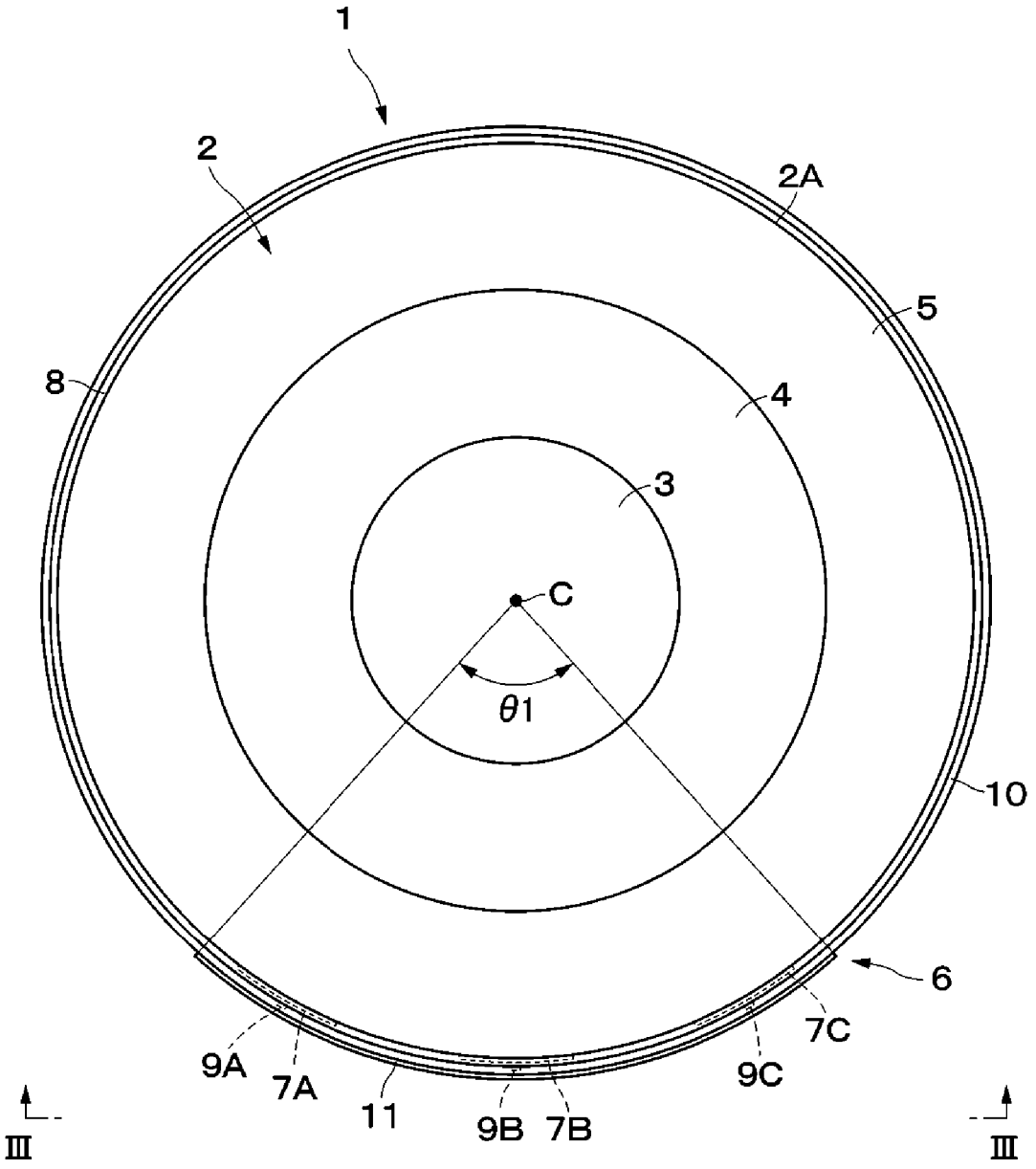
FIG. 2 is a plan view of the Luneburg lens antenna device shown in FIG. 1.
Figure 3:
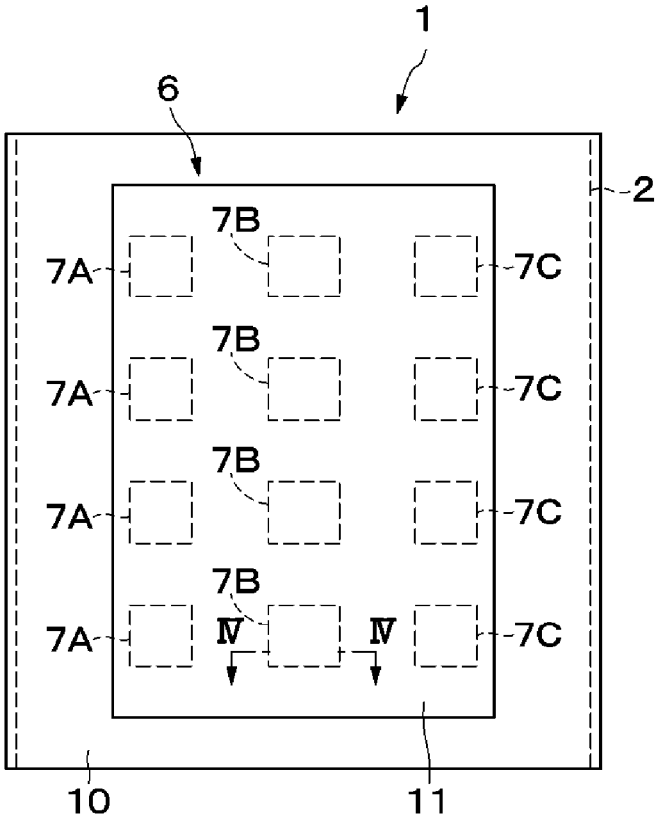
FIG. 3 is a front view of the Luneburg lens antenna device, as viewed from the direction of the arrows III-III of FIG. 2.
Figure 4:
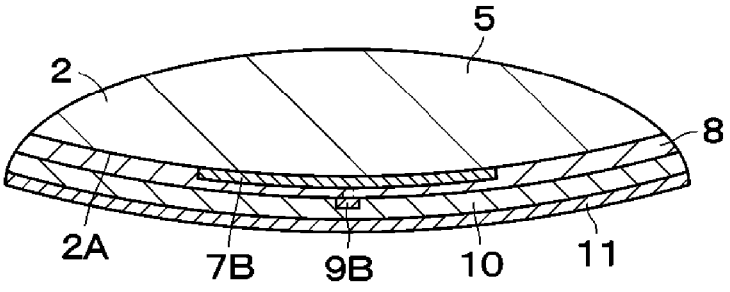
FIG. 4 is an enlarged sectional view of the major portion of a patch antenna, as viewed from the direction of the arrows IV-IV of FIG. 3.

The four patch antennas 7A are disposed at the same position in the peripheral direction and are also positioned on one side of the array antenna 6 in the peripheral direction (the counterclockwise base end portion of the array antenna 6 in FIG. 2). The four patch antennas 7A are disposed at equal intervals in the axial direction, for example.

The four patch antennas 7B are disposed at the same position in the peripheral direction and are also positioned at the center of the array antenna 6 in the peripheral direction. The four patch antennas 7B are thus disposed such that they are sandwiched between the patch antennas 7A and 7C. The four patch antennas 7B are disposed at equal intervals in the axial direction, for example.

The four patch antennas 7C are disposed at the same position in the peripheral direction and are also positioned on the other side of the array antenna 6 in the peripheral direction (the counterclockwise terminating end portion of the array antenna 6 in FIG. 2). The four patch antennas 7C are disposed at equal intervals in the axial direction, for example. The patch antennas 7A, 7B, and 7C are disposed in different columns and are able to send or receive radio-frequency signals independently of each other. Because of this configuration, the patch antennas 7A through 7C are applicable to, for example, MIMO having plural input and output terminals in the peripheral direction. The patch antennas 7A through 7C are also disposed at equal intervals in the peripheral direction, for example.

Figure 5:
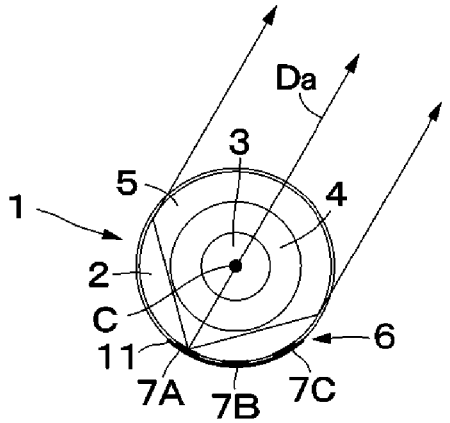
FIG. 5 illustrates a state in which a beam is radiated by a patch antenna disposed at one side in the peripheral direction.

The operation of each of the antennas will be discussed below. In this case, combining of operations of the multiple antennas by using MIMO technology is not performed. As shown in FIG. 5, the four patch antennas 7A form beams having directivity toward the opposite side of the patch antennas 7A with the central axis C of the Luneburg lens 2 therebetween. That is, the four patch antennas 7A form beams having the same directivity in the peripheral direction.

Signals having a predetermined relationship (phase relationship, for example) are supplied from the power supply electrode 9A to the four patch antennas 7A. This makes the beams formed by the four patch antennas 7A fixed with respect to the axial direction of the Luneburg lens 2.

Figure 6:
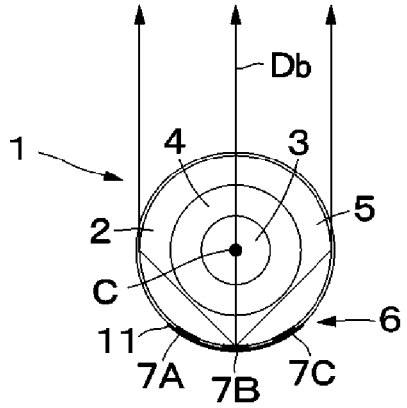
FIG. 6 illustrates a state in which a beam is radiated by a patch antenna disposed at the central side in the peripheral direction.

As shown in FIG. 6, the four patch antennas 7B, as well as the patch antennas 7A, form beams having directivity toward the opposite side of the patch antennas 7B with the central axis C of the Luneburg lens 2 therebetween. The patch antennas 7B are disposed at positions different from those of the patch antennas 7A in the peripheral direction of the Luneburg lens 2. Hence, the radiation direction (direction Db) of the beams formed by the patch antennas 7B is different from that (direction Da) of the beams formed by the patch antennas 7A.

Signals having a predetermined relationship are supplied from the power supply electrode 9B to the four patch antennas 7B. This makes the beams formed by the four patch antennas 7B fixed with respect to the axial direction of the Luneburg lens 2.

Figure 7:
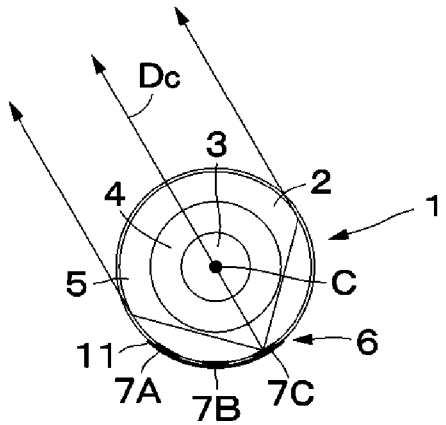
FIG. 7 illustrates a state in which a beam is radiated by a patch antenna disposed at the other side in the peripheral direction.

As shown in FIG. 7, the four patch antennas 7C, as well as the patch antennas 7A and 7B, form beams having directivity toward the opposite side of the patch antennas 7C with the central axis C of the Luneburg lens 2 therebetween. The patch antennas 7C are disposed at positions different from those of the patch antennas 7A and 7B in the peripheral direction of the Luneburg lens 2. Hence, the radiation direction (direction Dc) of the beams formed by the patch antennas 7C is different from that (direction Da) of the beams formed by the patch antennas 7A and that (direction Db) of the beams formed by the patch antennas 7B.

Signals having a predetermined relationship are supplied from the power supply electrode 9C to the four patch antennas 7C. This makes the beams formed by the four patch antennas 7C fixed with respect to the axial direction of the Luneburg lens 2.

On the outer peripheral surface 2A of the Luneburg lens 2, an insulating layer 8 is provided to cover all the patch antennas 7A through 7C. The insulating layer 8 is constituted by a tubular coating member, and the insulating layer 8 includes a contact layer, for example, for closely contacting the dielectric layer 5 and the patch antennas 7A through 7C of the Luneburg lens 2. The insulating layer 8 can have a smaller dielectric constant than that of the dielectric layer 5. The insulating layer 8 covers the entirety of the outer peripheral surface 2A of the Luneburg lens 2.

The power supply electrodes 9A through 9C are formed of long and narrow conductive film and are provided on the outer peripheral surface of the insulating layer 8. The power supply electrode 9A extends in the axial direction along the four patch antennas 7A, and the power supply electrode 9A is connected at its leading portion to each of the four patch antennas 7A. The power supply electrode 9B extends in the axial direction along the four patch antennas 7B, and the power supply electrode 9B is connected at its leading portion to each of the four patch antennas 7B. The power supply electrode 9C extends in the axial direction along the four patch antennas 7C, and the power supply electrode 9C is connected at its leading portion to each of the four patch antennas 7C. The base end portions of the power supply electrodes 9A through 9C are connected to a transmit-and-receive circuit 12. The power supply electrodes 9A through 9C form input and output terminals used in MIMO.

On the outer peripheral surface of the insulating layer 8, an insulating layer 10 is provided to cover the power supply electrodes 9A through 9C. The insulating layer 10 is formed of resin material having insulation properties. The insulating layer 10 covers the entirety of the outer peripheral surface 2A of the Luneburg lens 2.

The ground electrode 11 is provided on the outer peripheral surface of the insulating layer 10. The ground electrode 11 is formed of, for example, rectangular conductive film (metal film) extending in the peripheral direction and in the axial direction of the Luneburg lens 2, and covers all the patch antennas 7A through 7C. The ground electrode 11 is connected to an external ground and is maintained at a ground potential. This allows the ground electrode 11 to serve as a reflector.

The ground electrode 11 is formed in a range of an angle θ1 of 180 degrees or smaller with respect to the central axis C of the Luneburg lens 2. With this configuration, the array antenna 6 including the patch antennas 7A through 7C and the ground electrode 11 is formed in a range which is ½ or smaller of the entire range of the Luneburg lens 2 in the peripheral direction. If the range of the angle θ1 where the array antenna 6 is formed is large, the patch antennas 7A through 7C and the ground electrode 11 may partially interrupt radio waves. From this point of view, the array antenna 6 can be formed in a range of the angle θ1 of 90 degrees or smaller and be formed in a range which is ¼ or smaller of the entire range of the Luneburg lens 2 in the peripheral direction.

The transmit-and-receive circuit 12 is connected to the patch antennas 7A through 7C via the power supply electrodes 9A through 9C, respectively. The transmit-and-receive circuit 12 is able to transmit and receive signals independently to and from the patch antennas 7A through 7C disposed at different positions in the peripheral direction. The transmit-and-receive circuit 12 can thus scan beams over the predetermined angle range θ1. As a result of the transmit-and-receive circuit 12 supplying power to at least two columns of the patch antennas 7A through 7C together, the patch antennas which have received power can form multiple beams. In this embodiment, the array antenna 6 using the patch antennas 7A through 7C as antenna elements has been discussed. However, the antenna elements of the array antenna 6 are not restricted to patch antennas. For example, slot antennas may be used as antenna elements so as to form a slot array antenna.

The operation of the antenna device 1 according to this embodiment will be described below with reference to FIGS. 5 through 7.

When power is supplied from the power supply electrode 9A to the patch antennas 7A, a current flows through the patch antennas 7A, for example, in the axial direction. The patch antennas 7A then radiate a radio-frequency signal toward the Luneburg lens 2 in accordance with the axial-direction length of the patch antennas 7A. As a result, as shown in FIG. 5, the antenna device 1 can radiate a radio-frequency signal (beam) in the direction Da toward the opposite side of the patch antennas 7A with the central axis C of the Luneburg lens 2 therebetween. The antenna device 1 can also receive a radio-frequency signal coming from the direction Da by using the patch antennas 7A.

Likewise, as shown in FIG. 6, when power is supplied from the power supply electrode 9B to the patch antennas 7B, the antenna device 1 can transmit a radio-frequency signal in the direction Db toward the opposite side of the patch antennas 7B with the central axis C of the Luneburg lens 2 therebetween and can also receive a radio-frequency signal coming from the direction Db.

As shown in FIG. 7, when power is supplied from the power supply electrode 9C to the patch antennas 7C, the antenna device 1 can transmit a radio-frequency signal in the direction Dc toward the opposite side of the patch antenna 7C with the central axis C of the Luneburg lens 2 therebetween and can also receive a radio-frequency signal coming from the direction Dc.

By using both of the patch antennas 7A and 7B, the radiation direction of beams may be adjusted in a range between the directions Da and Db. Similarly, by using both of the patch antennas 7B and 7C, the radiation direction of beams may be adjusted in a range between the directions Db and Dc. This enables the antenna device 1 to radiate beams in a desirable direction within a range between the directions Da and Dc.

In the above-described example, by causing a current to flow through the patch antennas 7A through 7C in the axial direction, the patch antennas 7A through 7C radiate vertically polarized electromagnetic waves. However, the present disclosure is not restricted to this example. By causing a current to flow through the patch antennas 7A through 7C in the peripheral direction, the patch antennas 7A through 7C may radiate horizontally polarized electromagnetic waves. The patch antennas 7A through 7C may radiate circularly polarized electromagnetic waves.

In the first embodiment, the array antenna 6 includes the plural patch antennas 7A through 7C disposed on the outer peripheral surface 2A of the Luneburg lens 2 and at different positions of focal points in the peripheral direction of the Luneburg lens 2. Using of the plural patch antennas 7A through 7C disposed at different positions in the peripheral direction can form beams having low sidelobes in different directions. Operating the patch antennas 7A through 7C together can also form multiple beams. The plural patch antennas 7A, the plural patch antennas 7B, and the plural patch antennas 7C are each provided at different positions in the axial direction. This configuration makes it possible to make the beamwidth narrow in the axial direction, thereby increasing the antenna gain.

Additionally, the array antenna 6 is formed in a range which is ½ or smaller of the entire range of the Luneburg lens 2 in the peripheral direction. It is thus possible to scan beams in the peripheral direction in accordance with the range of the array antenna 6 in the peripheral direction.

The Luneburg lens 2 is formed in a cylindrical shape, so that the power supply electrodes 9A through 9C, which serve as signal connecting lines, can be formed on the outer peripheral surface 2A of the Luneburg lens 2. The antenna device 1 can thus extract signals more easily than when using a spherical Luneburg lens.

In the array antenna 6, among the plural patch antennas 7A through 7C, patch antennas disposed at different positions in the axial direction of the Luneburg lens 2 are operated mutually dependently. In this case, plural patch antennas disposed at different positions in the axial direction of the Luneburg lens (four patch antennas 7A, for example) are not formed as a MIMO configuration, but plural patch antennas 7A through 7C disposed at different positions in the peripheral direction of the Luneburg lens 2 are formed as a MIMO configuration. Signals having a predetermined relationship, such as signals having a fixed phase difference, are supplied to the four patch antennas 7A arranged in the axial direction, thereby making beams fixed with respect to the axial direction. This also applies to the patch antennas 7B and 7C. Among the patch antennas 7A through 7C, patch antennas arranged in the axial direction can be connected to each other by a passive circuit, such as a fixed phase shifter. That is, signals are independently supplied to the three columns of the patch antennas 7A through 7C disposed at different positions in the peripheral direction. As a result, fewer input and output circuits are required for the transmit-and-receive circuit 12, thereby making it possible to simplify the configuration of the antenna device 1.

Figure 8:
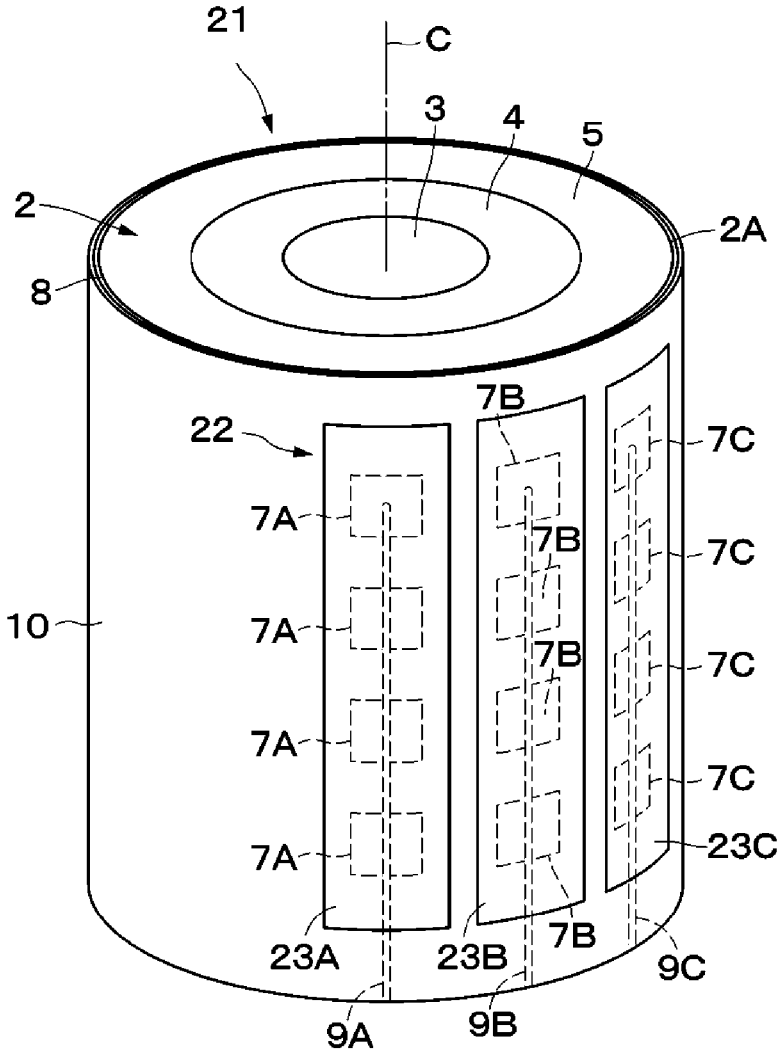
FIG. 8 is a perspective view of a Luneburg lens antenna device according to a second embodiment.
Figure 9:
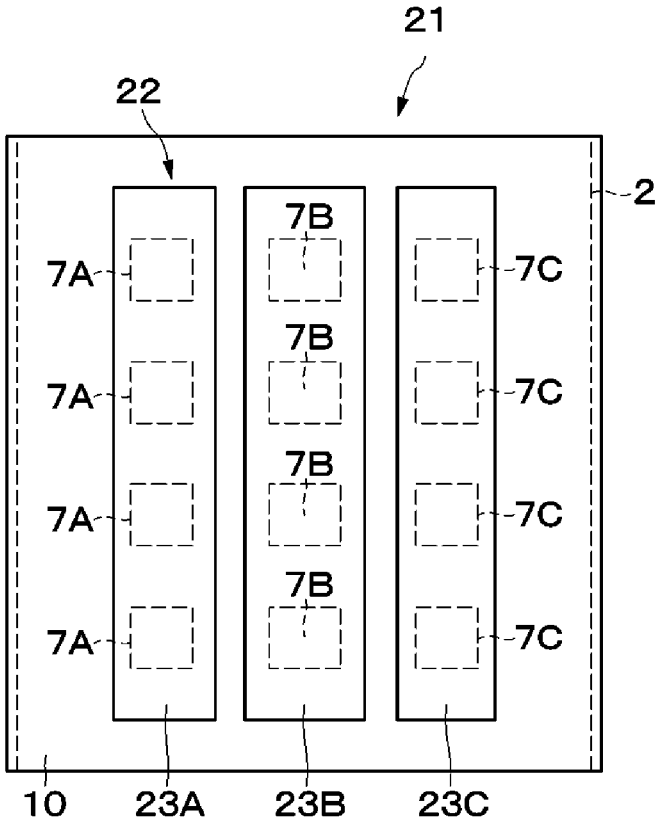
FIG. 9 is a front view of the Luneburg lens antenna device according to the second embodiment, as viewed from a direction similar to that in FIG. 3.

A Luneburg lens antenna device 21 (hereinafter called the antenna device 21) according to a second embodiment of the present disclosure is shown in FIGS. 8 and 9. The second embodiment is characterized in that three ground electrodes 23A through 23C are provided separately from each other in association with three respective columns of patch antennas 7A through 7C disposed at different positions in the peripheral direction. While describing the antenna device 21, elements having the same configurations as those of the antenna device 1 of the first embodiment are designated by like reference numerals, and an explanation thereof will thus be omitted.

The configuration of the antenna device 21 according to the second embodiment is basically similar to that of the antenna device 1 according to the first embodiment. The antenna device 21 includes the Luneburg lens 2 and an array antenna 22.

The configuration of the array antenna 22 of the second embodiment is basically similar to that of the array antenna 6 of the first embodiment. The array antenna 22 includes the patch antennas 7A through 7C, the power supply electrodes 9A through 9C, and the ground electrodes 23A through 23C.

However, the ground electrodes 23A through 23C are provided separately from each other in the peripheral direction in association with the three columns of patch antennas 7A through 7C disposed at different positions in the peripheral direction. In this point, the ground electrodes 23A through 23C are different from the ground electrode 11 of the first embodiment, which is provided to cover all the patch antennas 7A through 7C.

The ground electrodes 23A through 23C are formed in a rectangular shape, for example, extending in the axial direction, and are provided on the outer peripheral surface of the insulating layer 10. The ground electrode 23A covers the four patch antennas 7A. The ground electrode 23B covers the four patch antennas 7B. The ground electrode 23C covers the four patch antennas 7C. The ground electrodes 23A through 23C are disposed separately such that they are equally spaced in the peripheral direction.

In the second embodiment, advantages similar to those of the first embodiment can also be obtained. The use of a single ground electrode as in the first embodiment may cause diffraction of electromagnetic waves at an end portion of the ground electrode 11. Hence, in the first embodiment, the beamwidth and the shape of sidelobes of beams formed by the patch antennas 7A and 7C positioned at the end portions in the peripheral direction tend to be different from those of beams formed by the patch antennas 7B positioned at the center in the peripheral direction.

In contrast, in the second embodiment, the three ground electrodes 23A through 23C are provided separately from each other in association with the three columns of patch antennas 7A through 7C disposed at different positions in the peripheral direction. With this configuration, the patch antennas 7A through 7C can form beams having substantially the same beamwidths and substantially the same shapes of sidelobes.

Figure 10:
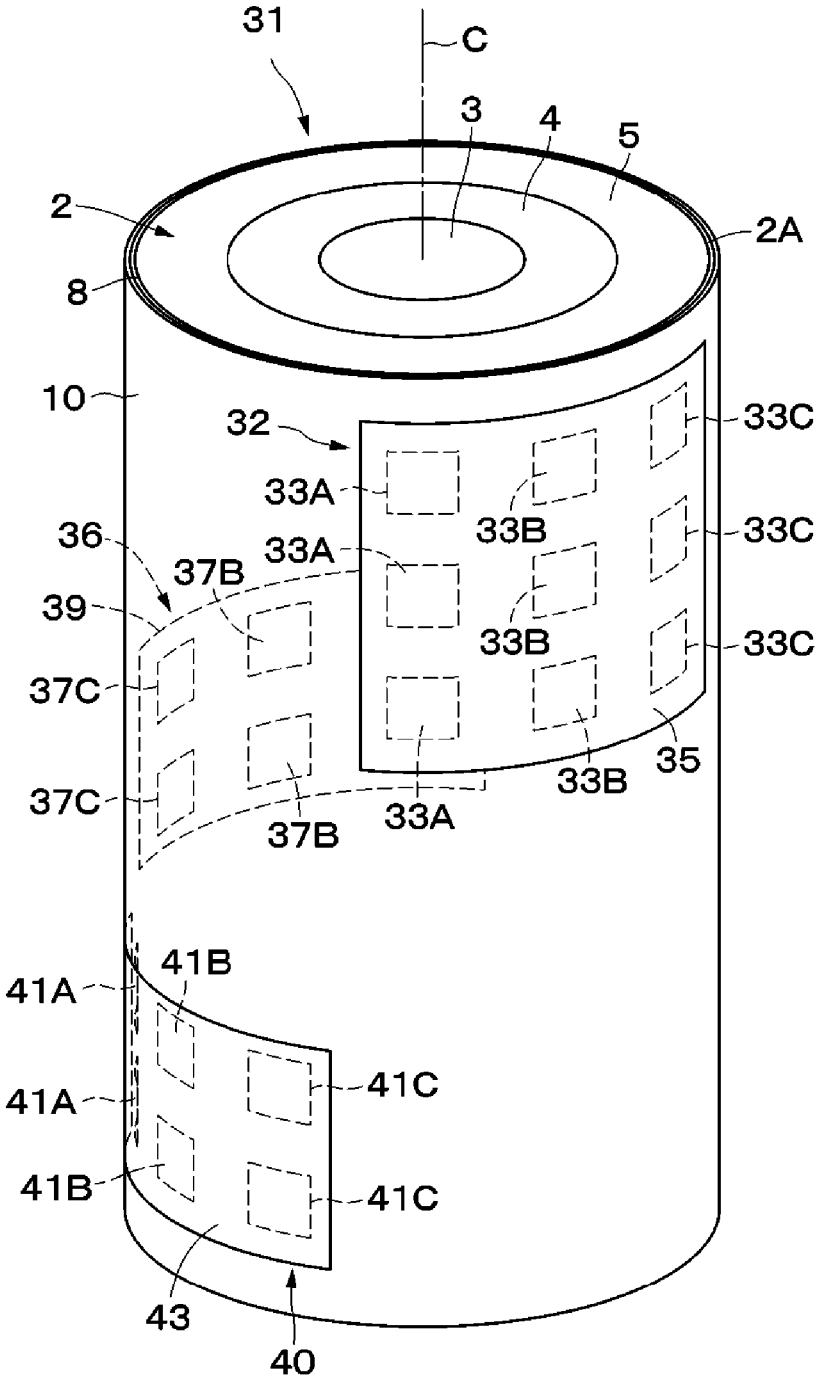
FIG. 10 is a perspective view of a Luneburg lens antenna device according to a third embodiment without power supply electrodes.
Figure 11:
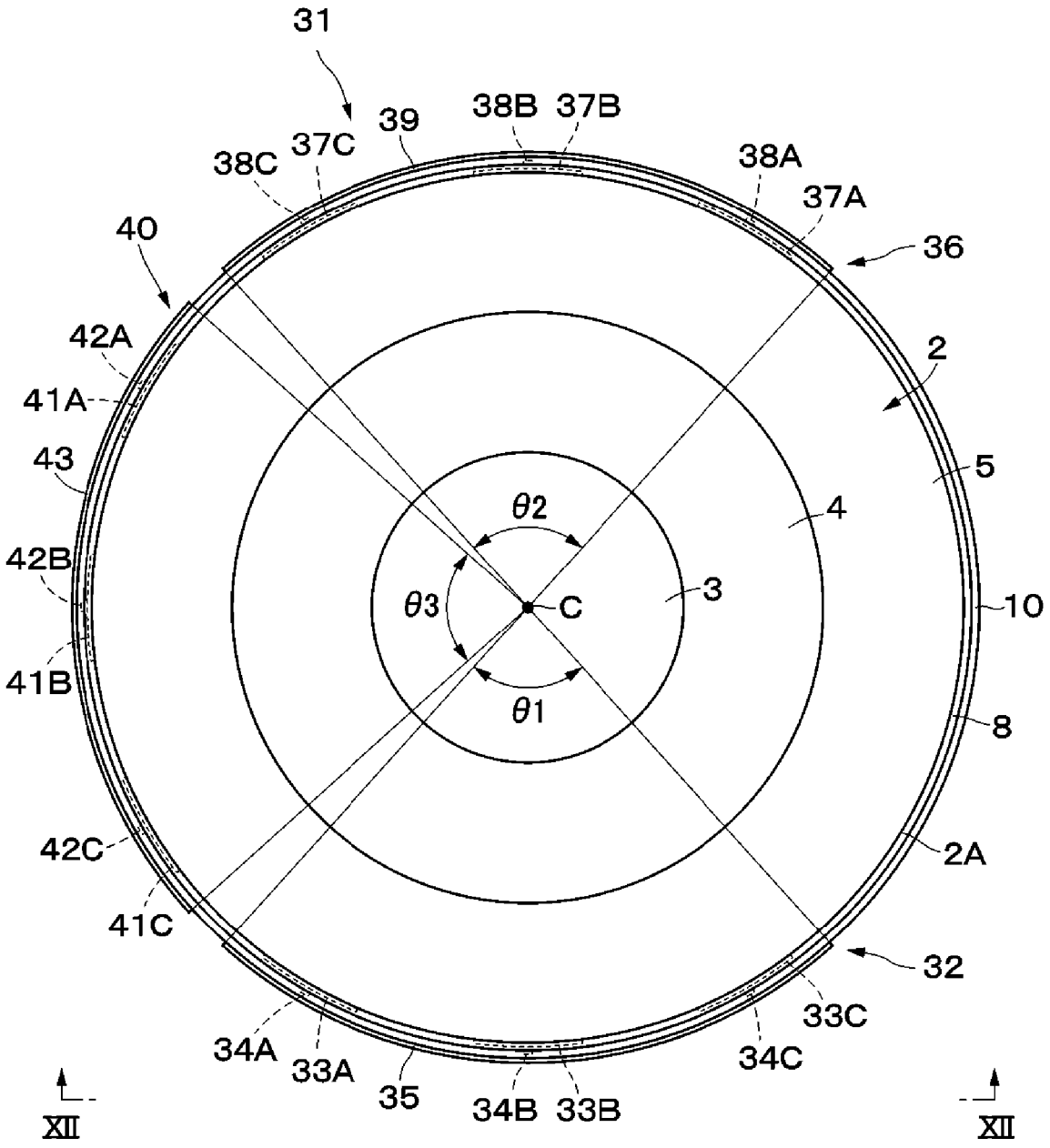
FIG. 11 is a plan view of the Luneburg lens antenna device shown in FIG. 10.
Figure 12:
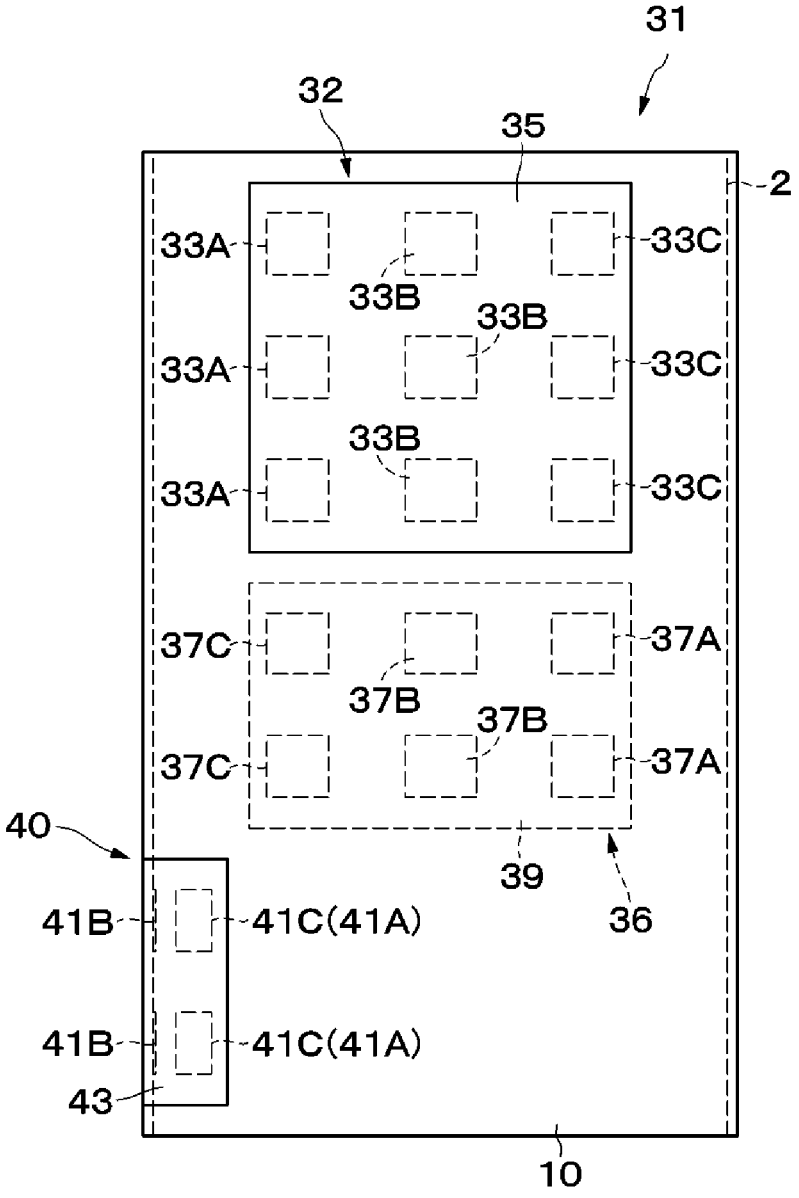
FIG. 12 is a front view of the Luneburg lens antenna device, as viewed from the direction of the arrows XII-XII of FIG. 11.

A Luneburg lens antenna device 31 (hereinafter called the antenna device 31) according to a third embodiment of the present disclosure is shown in FIGS. 10 through 12. The third embodiment is characterized in that plural array antennas are provided at different positions of a Luneburg lens in the axial direction. While describing the antenna device 31, elements having the same configurations as those of the antenna device 1 of the first embodiment are designated by like reference numerals, and an explanation thereof will thus be omitted.

The configuration of the antenna device 31 according to the third embodiment is basically similar to that of the antenna device 1 according to the first embodiment. The antenna device 31 includes the Luneburg lens 2 and array antennas 32, 36, and 40. However, the antenna device 31 is different from the antenna device 1 of the first embodiment in that it includes the three array antennas 32, 36, and 40 provided at different positions in the axial direction.

The configuration of the array antenna 32 is basically similar to that of the array antenna 6 of the first embodiment. The array antenna 32 includes patch antennas 33A through 33C formed in a matrix of three rows by three columns, power supply electrodes 34A through 34C, and a ground electrode 35. The array antenna 32 is formed in a range of an angle θ1 of 90 degrees or smaller with respect to the central axis C of the Luneburg lens 2, and is formed in a range which is ½ or smaller of the entire range of the Luneburg lens 2 in the peripheral direction. The array antenna 32 can be formed in a range which is ¼ or smaller of the entire range of the Luneburg lens 2 in the peripheral direction.

The array antenna 32 is located at the highest position in the axial direction of the Luneburg lens 2. Among the patch antennas 33A through 33C, the array antenna 32 has more patch antennas in the axial direction (more rows of patch antennas) than the other array antennas 36 and 40. With this configuration, the beamwidth of axial-direction beams formed by the array antenna 32 becomes narrower than that formed by the array antennas 36 and 40. As a result, the array antenna 32 achieves high gain and generates beams that can reach a far side as well as a near side.

The array antenna 36 includes patch antennas 37A through 37C formed in a matrix of two rows by three columns, power supply electrodes 38A through 38C, and a ground electrode 39. The array antenna 36 is formed in a range of an angle θ2 of 90 degrees or smaller with respect to the central axis C of the Luneburg lens 2, and is formed in a range which is ½ or smaller of the entire range of the Luneburg lens 2 in the peripheral direction. The array antenna 36 can be formed in a range which is ¼ or smaller of the entire range of the Luneburg lens 2 in the peripheral direction.

The array antenna 36 is located at a position lower than the array antenna 32 and higher than the array antenna 40 in the axial direction of the Luneburg lens 2. The array antenna 36 has patch antennas 37A through 37C. The array antenna 36 has fewer patch antennas in the axial direction (fewer rows of patch antennas) than the array antenna 32. With this configuration, the beamwidth of axial-direction beams formed by the array antenna 36 becomes wider than that formed by the array antenna 32. As a result, the array antenna 36 achieves low gain and generates beams that can reach a near side.

The array antenna 40 includes patch antennas 41A through 41C formed in a matrix of two rows by three columns, power supply electrodes 42A through 42C, and a ground electrode 43. The array antenna 40 is formed in a range of an angle θ3 of 90 degrees or smaller with respect to the central axis C of the Luneburg lens 2, and is formed in a range which is ½ or smaller of the entire range of the Luneburg lens 2 in the peripheral direction. The array antenna 40 is formed in a range which is ¼ or smaller of the entire range of the Luneburg lens 2 in the peripheral direction.

The array antenna 40 is located at the lowest position in the axial direction of the Luneburg lens 2. The array antenna 40 has patch antennas 41A through 41C. As in the array antenna 36, the array antenna 40 has fewer patch antennas in the axial direction (fewer rows of patch antennas) than the array antenna 32. With this configuration, the beamwidth of axial-direction beams formed by the array antenna 40 becomes wider than that formed by the array antenna 32.

In this manner, the three array antennas 32, 36, and 40 are disposed at different positions from each other with respect to the axial direction of the Luneburg lens 2. The array antennas 32, 36, and 40 are also disposed at different positions from each other with respect to the peripheral direction of the Luneburg lens 2. As shown in FIG. 11, the end portion of the other side of the array antenna 36 in the peripheral direction (the counterclockwise terminating end portion where the patch antenna 37C is disposed in FIG. 11) is located at a position adjacent to the end portion of one side of the array antenna 40 (the counterclockwise base end portion where the patch antenna 41A is disposed in FIG. 11). The end portion of the other side of the array antenna 40 in the peripheral direction (the counterclockwise terminating end portion where the patch antenna 41C is disposed in FIG. 11) is located at a position adjacent to the end portion of one side of the array antenna 32 (the counterclockwise base end portion where the patch antenna 33A is disposed in FIG. 11). As a result, the three array antennas 32, 36, and 40 as a whole can radiate beams over the total range of angles θ1 through θ3.

As shown in FIGS. 10 and 11, to efficiently arrange the three array antennas 32, 36, and 40, they can be disposed so as not to overlap each other when the Luneburg lens 2 is viewed from above. However, the present disclosure is not restricted to this arrangement. For example, part of the angle range (angle range of 0 to 90 degrees, for example) of one array antenna may overlap that of another array antenna, such as a first array antenna is disposed in an angle range of 0 to 90 degrees, a second array antenna is disposed in an angle range of 0 to 110 degrees, and a third array antenna is disposed in an angle range of 0 to 140 degrees. That is, concerning plural array antennas provided at different positions in the axial direction, it is sufficient if the ranges in which the plural array antennas are provided in the peripheral direction are at least partially different from each other. In other words, the ranges of the plural array antennas in the peripheral direction may partially overlap each other.

In the third embodiment, advantages similar to those of the first embodiment can also be obtained. In the third embodiment, the plural array antennas 32, 36, and 40 are provided at different positions of the Luneburg lens 2 in the axial direction. The range of angles of beam scanning thus becomes wider than that when a single array antenna is used.

The array antenna 32 has more patch antennas 33A through 33C in the axial direction than the patch antennas 37A through 37C of the array antenna 36 and the patch antennas 41A through 41C of the array antenna 40. The array antenna 32 can thus form beams having high directivity that can reach a far side. In contrast, the array antennas 36 and 40 can form beams having low directivity that can reach a near side over a wide angle range. With this configuration, in response to the specifications of the antenna device 31 in which the characteristics are different in the peripheral direction, the antenna device 31 can generate beams having different shapes in accordance with the demanded characteristics.

The array antennas 32 and 36 adjacent to each other in the axial direction are disposed at different positions by 180 degrees with respect to the Luneburg lens 2. Accordingly, a gap having an angle of 90 degrees or greater in the peripheral direction is formed between the array antennas 32 and 36. As a result, the interaction of beams between the array antennas 32 and 36 can be reduced.

In the third embodiment, the provision of the three array antennas 32, 36, and 40 makes it possible to scan beams over an angle range of about 270 degrees. However, the present disclosure is not restricted to this configuration. For example, four array antennas each having an angle range of about 90 degrees may be provided so that the antenna device 31 can scan beams all around (360 degrees) the Luneburg lens 2.

Figure 13:
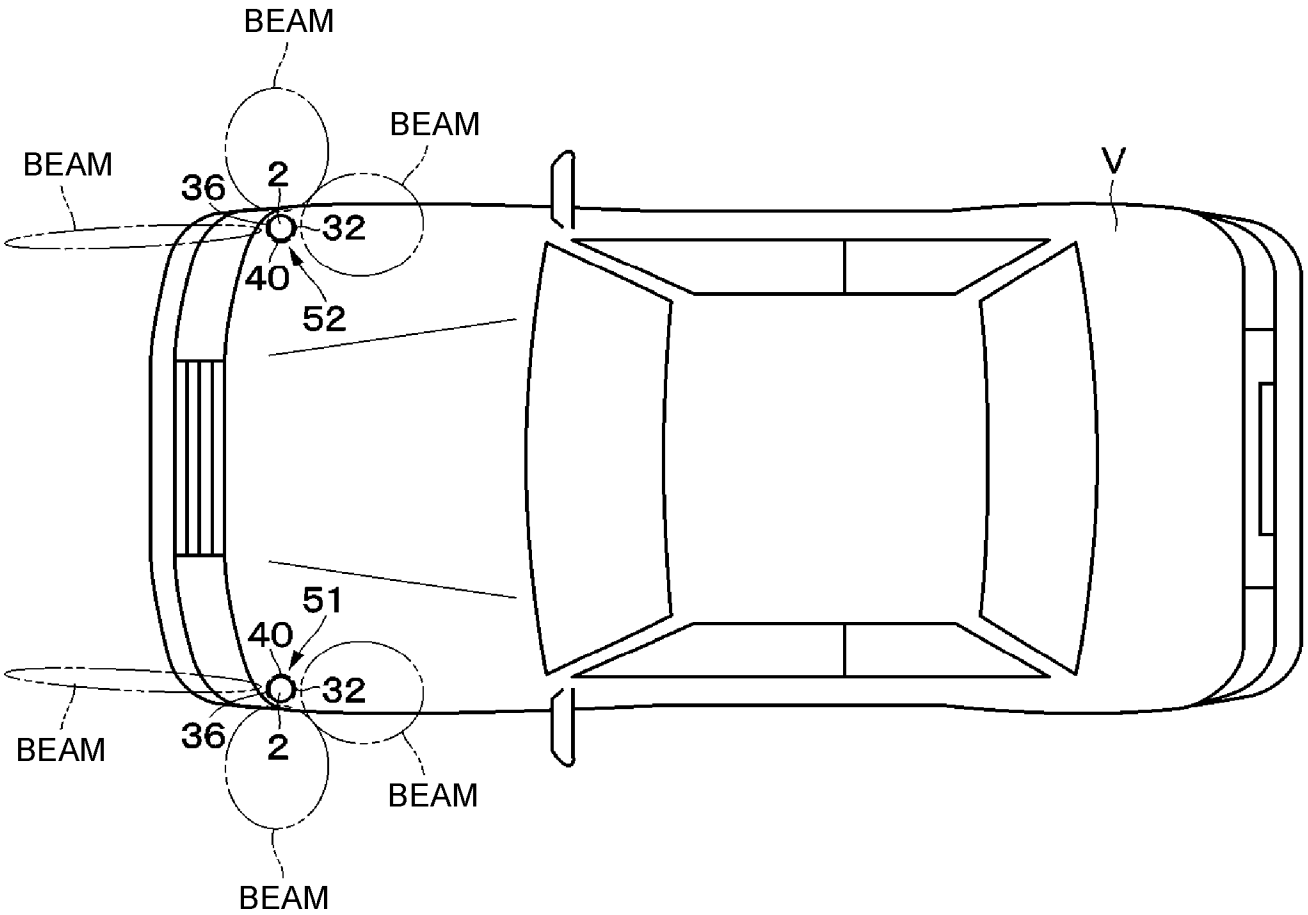
FIG. 13 illustrates a state in which Luneburg lens antenna devices according to a fourth embodiment are used for radar mounted on a vehicle.

Luneburg lens antenna devices 51 and 52 (hereinafter called the antenna devices 51 and 52) according to a fourth embodiment of the present disclosure are shown in FIG. 13. The fourth embodiment is characterized in that the antenna devices 51 and 52 are used for radar mounted on a vehicle V. While describing the antenna devices 51 and 52, elements having the same configurations as those of the antenna device 31 of the third embodiment are designated by like reference numerals, and an explanation thereof will thus be omitted.

The configuration of the antenna device 51 is basically similar to that of the antenna device 31 according to the third embodiment. The antenna device 51 includes the array antennas 32, 36, and 40. The antenna device 51 is provided on the left side of the vehicle V. The array antenna 32 is disposed at a position on the back side of the Luneburg lens 2. The array antenna 36 is disposed at a position on the front side of the Luneburg lens 2. The array antenna 40 is disposed at a position on the right side of the Luneburg lens 2. The antenna device 51 configured as described above can thus radiate beams toward the front, back, and left sides of the vehicle V.

The configuration of the antenna device 52 is basically similar to that of the antenna device 31 according to the third embodiment. The antenna device 52 includes the array antennas 32, 36, and 40. The antenna device 52 is provided on the right side of the vehicle V. The array antenna 32 is disposed at a position on the back side of the Luneburg lens 2. The array antenna 36 is disposed at a position on the front side of the Luneburg lens 2. The array antenna 40 is disposed at a position on the left side of the Luneburg lens 2. The antenna device 52 configured as described above can thus radiate beams toward the front, back, and right sides of the vehicle V.

In the fourth embodiment, advantages similar to those of the third embodiment can also be obtained. In the fourth embodiment, the antenna devices 51 and 52 radiate beams toward the front direction of the vehicle V by using the high-gain array antennas 32, so that they can detect vehicles ahead in the distance, for example. Meanwhile, the antenna devices 51 and 52 radiate wide-angle beams toward the back and lateral directions of the vehicle V by using the low-gain array antennas 36 and 40, so that they can detect obstacles in a wide range in the back, left, and right directions of the vehicle V.

In the above-described first embodiment, in the array antenna 6, the power supply electrodes 9A through 9C are respectively disposed between the patch antennas 7A through 7C and the ground electrode 11. However, the present disclosure is not restricted to this configuration. Power supply electrodes may be provided on the outer side of the ground electrode in the radial direction and may be connected to the patch antennas via through-holes provided in the ground electrode. In the second through fourth embodiments, too, the array antenna 6 may be configured in this manner.

In the above-described first embodiment, the array antenna 6 has the twelve patch antennas 7A through 7C arranged in a matrix of four rows by three columns. However, the present disclosure is not restricted to this configuration. The number and the arrangement of the patch antennas may be adjusted suitably according to the specifications of the array antenna, for example. In the second through fourth embodiments, too, the number and the arrangement of the patch antennas may be adjusted suitably.

In the above-described first embodiment, in the array antenna 6, plural patch antennas disposed at different positions in the axial direction of the Luneburg lens 2 (four patch antennas 7A, for example) are operated mutually dependently. However, the present disclosure is not restricted to this configuration. In the array antenna, signals may independently be supplied to plural patch antennas disposed at different positions in the axial direction so that the patch antennas can operate independently of each other. This makes it possible to adjust the radiation direction and the shape of beams in the axial direction. In the second through fourth embodiments, too, the array antenna 6 may be configured in this manner.

In the above-described third embodiment, all the array antennas 32, 36, and 40 have three columns of patch antennas 33A through 33C, 37A through 37C, and 41A through 41C, respectively, at different positions in the peripheral direction. However, the present disclosure is not restricted to this configuration. Concerning each of plural array antennas provided at different positions in the axial direction, the number of patch antennas in one column may be different from that in another column. In the fourth embodiment, too, the array antennas 32, 36, and 40 may be configured in this manner.

In the above-described third embodiment, regarding the array antennas 32, 36, and 40 disposed at different positions in the axial direction of the Luneburg lens 2, the number of patch antennas arranged in the axial direction among the patch antennas 33A through 33C is different from that of each of the array antennas 36 and 40 among the patch antennas 37A through 37C and 41A through 41C. However, the present disclosure is not restricted to this configuration. Plural patch antennas disposed at different positions in the axial direction may have the same number of patch antennas in the axial direction. If a Luneburg lens antenna device including array antennas configured as described above is used for a mobile communication base station, it can radiate beams in all directions uniformly.

The above-described embodiments are only examples. The configurations described in the different embodiments may partially be replaced by or combined with each other.

REFERENCE SIGNS LIST

1, 21, 31, 51, 52 Luneburg lens antenna device (antenna device)
2 Luneburg lens
3 to 5 dielectric layer
6, 22, 32, 36, 40 array antenna
7A to 7C, 33A to 33C, 37A to 37C, 41A to 41C patch antenna
9A to 9C, 34A to 34C, 38A to 38C, 42A to 42C power supply electrode
11, 23A to 23C, 35, 39, 43 ground electrode
12 transmit-and-receive circuit

What is claimed is:

1. A Luneburg lens antenna device comprising:

a Luneburg lens that is formed in a cylindrical shape and has a distribution of different dielectric constants, wherein the dielectric constants are a function of a radial distance from a central axis of the cylindrical shape; and a plurality of array antennas each comprising a plurality of antenna elements disposed on an outer peripheral surface of the Luneburg lens and at different positions along both a peripheral direction and an axial direction of the Luneburg lens, wherein:

the plurality of array antennas are provided on the outer peripheral surface over a range of 180 degrees or less about the central axis, the plurality of array antennas are provided at different positions of the Luneburg lens in the axial direction, and at least one of the plurality of array antennas covers a different range of the outer peripheral surface in the peripheral direction.

2. The Luneburg lens antenna device according to claim 1, wherein at least one of the plurality of array antennas comprises a different number of antenna elements in the axial direction than another of the plurality of array antennas.

3. A Luneburg lens antenna device comprising:

a Luneburg lens that is formed in a cylindrical shape and has a distribution of different dielectric constants, wherein the dielectric constants are a function of a radial distance from a central axis of the cylindrical shape; and an array antenna comprising a plurality of antenna elements disposed on an outer peripheral surface of the Luneburg lens and at different positions along both a peripheral direction and an axial direction of the Luneburg lens, wherein:

the array antenna is provided on the outer peripheral surface over a range of 180 degrees or less about the central axis, the plurality of antenna elements are disposed directly on the outer peripheral surface, at least one insulating layer is provided on the plurality of antenna elements, and at least one ground layer is provided on the at least one insulating layer.

4. The Luneburg lens antenna device according to claim 3, wherein a different ground layer is provided for each of the plurality of antenna elements disposed at a different position in the peripheral direction.

5. The Luneburg lens antenna device according to claim 1, wherein each antenna element in one of the plurality of antenna arrays that is disposed at a different position in the axial direction is operated mutually dependently.

6. The Luneburg lens antenna device according to claim 3, wherein each antenna element in the array antenna that is disposed at a different position in the axial direction is operated mutually dependently.

* * * * *